US006380850B1

(12) United States Patent
Parker

(10) Patent No.: US 6,380,850 B1
(45) Date of Patent: Apr. 30, 2002

(54) DUAL MODE PANEL

(75) Inventor: James Parker, Thornhill (CA)

(73) Assignee: Digital Security Controls Ltd., Concord (CA)

( * ) Notice: Subject to any disclaimer, the term of this patent is extended or adjusted under 35 U.S.C. 154(b) by 0 days.

(21) Appl. No.: 09/529,344

(22) PCT Filed: Dec. 23, 1999

(86) PCT No.: PCT/CA99/01220

§ 371 Date: Apr. 13, 2000

§ 102(e) Date: Apr. 13, 2000

(87) PCT Pub. No.: WO00/41152

PCT Pub. Date: Jul. 13, 2000

(30) Foreign Application Priority Data

Jan. 5, 1999 (CA) ..... 2258817

(51) Int. Cl.[7] ..... G08B 29/00

(52) U.S. Cl. ..... 340/506; 340/514; 340/527; 340/528; 340/825.31; 307/10.4

(58) Field of Search ..... 340/506, 507, 340/514, 527, 528, 825.06, 825.3, 825.31, 825.32, 305.19; 307/10.4

(56) References Cited

U.S. PATENT DOCUMENTS 5,400,246 A * 3/1995 Wilson et al. ..... 340/825.06 X
5,850,753 A * 12/1998 Varma ..... 70/278
5,872,513 A * 2/1999 Fitzgibbon et al. ..... 340/539
6,078,254 A * 6/2000 Parker ..... 340/514

* cited by examiner

*Primary Examiner*—Daryl Pope

(57) ABSTRACT

A dual mode alarm control panel includes a sensing arrangement for determining conditions of the environment in which the panel is installed. The results of the environmental assessment are used to determine an operating mode of the panel. In a first mode the panel is fully functional, and in a second mode the functions of the panel are restricted. This process assists in operating alarm control panels in an environment corresponding to the assumed design environment. In this way, non-compliance or operating alarm panels in unsuitable environments is reduced or avoided.

12 Claims, 3 Drawing Sheets

DUAL MODE PANEL

RELATED APPLICATIONS

This application claims priority to international application PCT/CA99/01220 filed Dec. 23, 1999.

FIELD OF THE INVENTION

The present invention relates to alarm control panels used in a security system, and in particular, relates to a panel which senses certain environmental conditions to determine which of two different modes it should operate in.

BACKGROUND OF THE INVENTION

Alarm control panels are used to receive inputs from various sensors as well as inputs from a keypad and the panel monitors these various signals and produces an alarm when certain events have been detected. The alarm panel also includes the capability to communicate with a remote monitoring station, typically by means of a telephone company to report an alarm event or merely to check-in with the remote monitoring station. As part of the security protocol, the remote monitoring station may contact the alarm panel from time to time to seek information therefrom.

The security system is designed to receive power from the power supply of the premise and it is also designed to be connected to the telephone system. It is important that the control panel meets the standard set for equipment to be connected to the telephone system. This standard varies from country to country and a product which does not comply often goes undetected until such time as the control panel disrupts the normal operation of the telephone system. There is some built in control as commercial installers only use appropriate equipment and often provide service or are associated with the monitoring service. Therefore, non-complying equipment is not a significant problem for authorized installation of a security system, however, problems can occur during a reinstallation or an installation carried out by a non-commercial installer.

SUMMARY OF THE INVENTION

In a alarm control panel for processing signals from sensors and from a keypad and reporting of certain sense conditions to a monitoring station, the alarm control panel includes means for analyzing an electrical feed provided to the alarm control panel. The analysis of the electrical feed includes comparing an electrical feed provided to the panel to a pre-determined stored value. The alarm control panel operates in a first mode based on a match between the analyzed electrical signal and the stored value, and operates in a second mode when the analyzed electrical feed and the stored value do not match. The alarm control panel, in the first mode, is fully functional and the panel in the second mode has the panel functions restricted.

According to a preferred aspect of the invention, the electrical feed is a power feed provided to the security panel.

According to a further aspect of the invention, the electrical feed is a telecommunication feed provided to the alarm panel.

According to yet a further aspect of the invention, when the alarm control panel operates in the second mode, the alarm control panel is disconnected from a telecommunication port used in the first mode for communication transmissions with a monitoring station.

According to yet a further aspect of the invention, the alarm control panel operates such that a means for analyzing the electrical feed is activated each time the alarm control panel is connected to a supply power source.

According to another aspect of the invention, the analyzed electrical feed is frequency analyzed and a stored value is a frequency value. An improved alarm control panel, according to the present invention, processes a signal from sensors and a keypad and reports certain sensed conditions to a monitoring station. The alarm control panel includes means for analyzing a telecommunication signal associated with a telecommunication port of the panel which is to be connected to a public telecommunication system. The panel compares the analyzed electrical telecommunication signal to a standard, and based on the comparison, determines the approximate geographic location of the security panel. The alarm control panel operates in a first mode based on a match between the determined approximate geographic location and the standard, and operates in a second mode when the determined approximate location and this standard do not match. The alarm control panel in the first mode is in a full function mode and the panel in the second mode has limited functionality.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
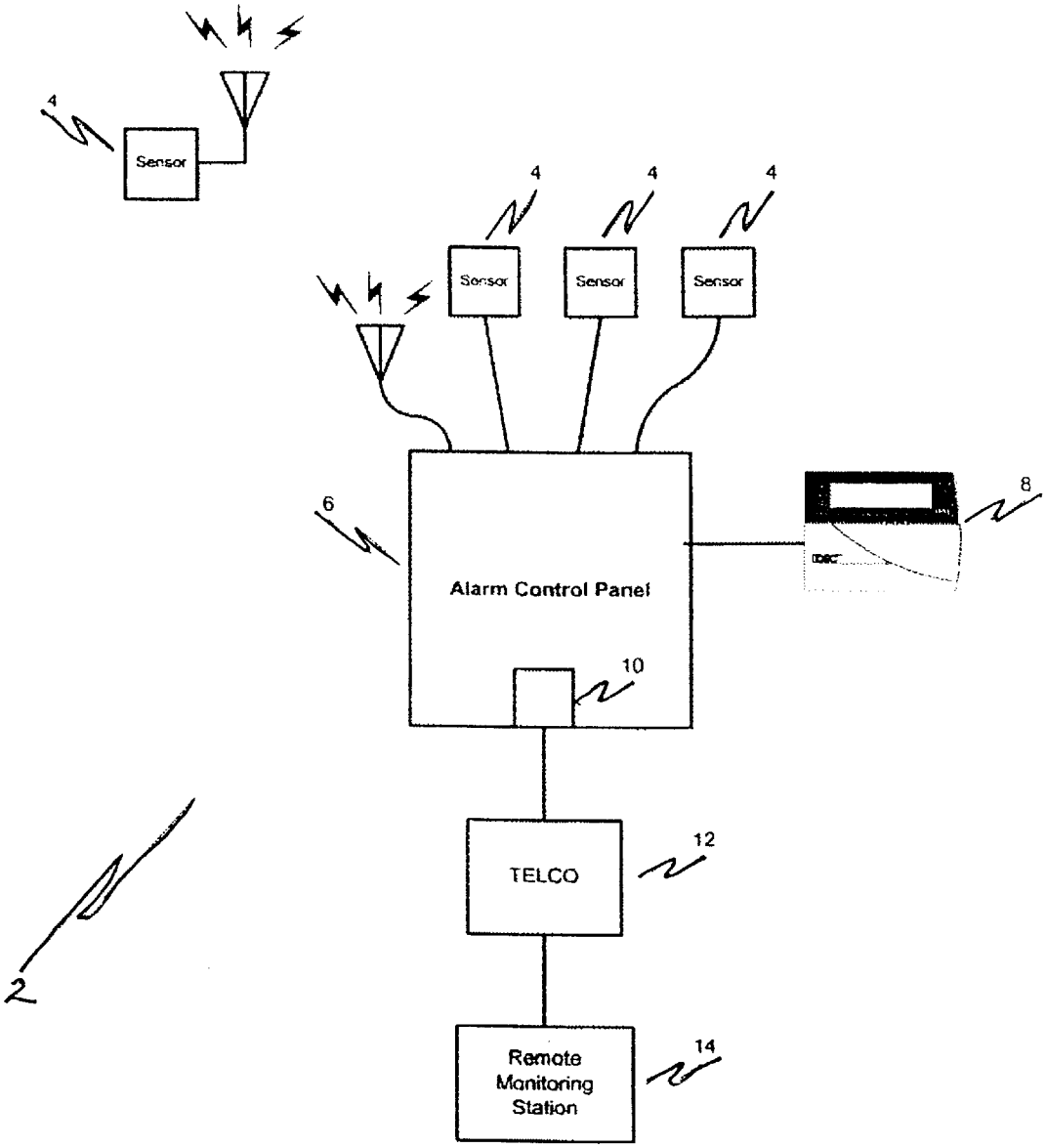
FIG. 1 shows a schematic of a security system in communication with a remote monitoring station.

The security system 2 includes a plurality of sensors 4 connected to an alarm control panel 6 which also interacts with the keypad 8. The sensors and keypad can be hard wired to the alarm control panel, or can include a wireless connection, or combinations thereof. The alarm control panel 6 also includes a communication port 10 used to connect the alarm control panel 6 to a public switched telephone system indicated by the TELCO 12. In this way, the alarm control panel can communicate with the remote monitoring station 14 or the remote monitoring station 14 can initiate communication and query the alarm control panel. The arrangement shown in FIG. 1 is conventional.

Figure 2:
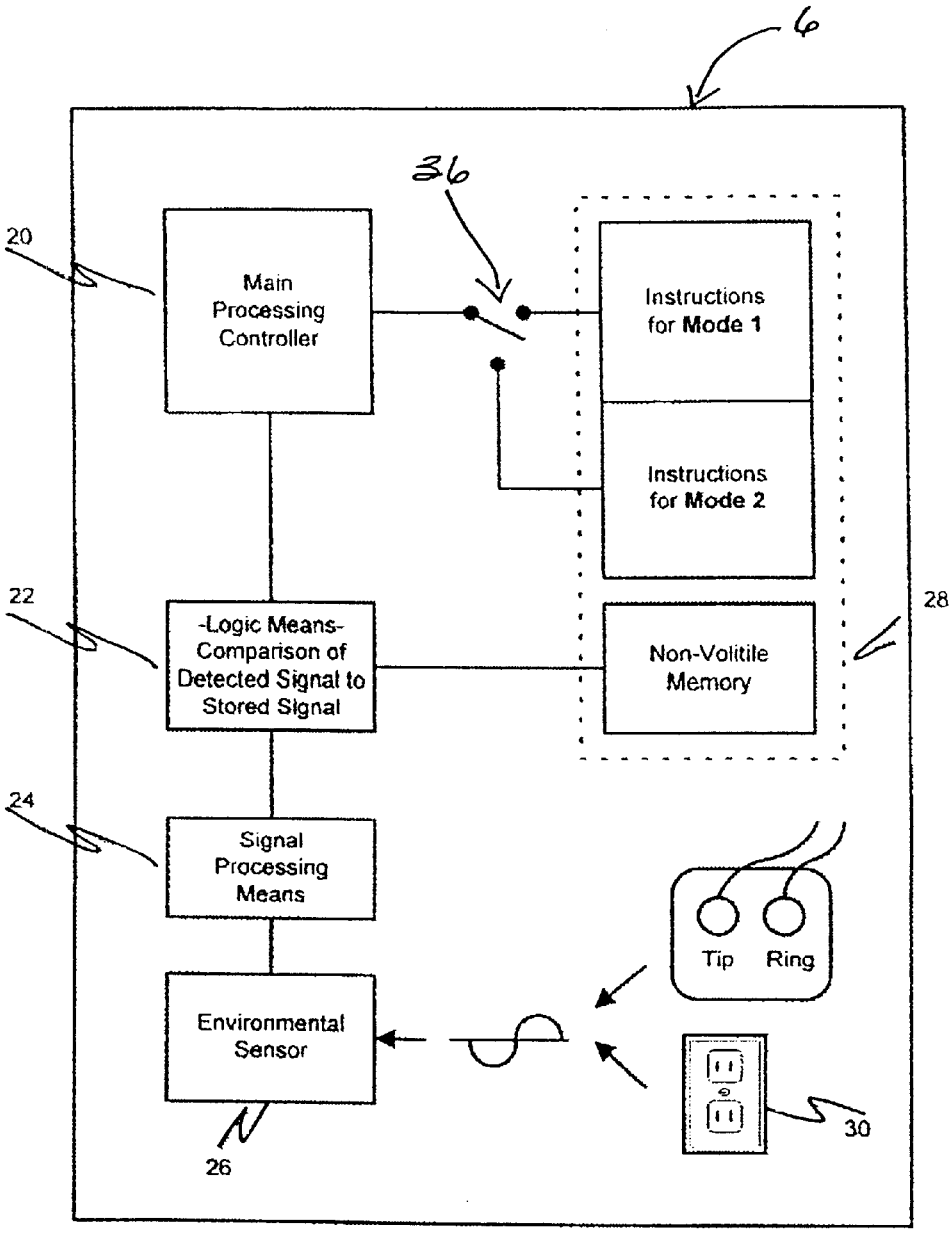
FIG. 2 is a schematic showing additional details of the alarm control panel.

FIG. 2 is a schematic showing certain additional embodiments of the alarm control panel 6. This panel includes a main processing controller 20, used by the panel to process the signals from the sensors and from the keypad. In the embodiment shown in FIG. 2, this main processor is initially programmed by the instruction set associated with mode 1, or the instruction set associated with mode 2.

When the alarm control panel is initially connected to the power source, indicated by outlet 30, the power is fed to an environmental sensor 26 which senses conditions of the power and/or communication environment of the installation location. This environmental sensor 26 analyzes the powering signal by means of a signal processing arrangement 24. The signal processing arrangement extracts certain key data from the powering signal and feeds the output to the comparator 22. The comparator 22 compares the detected signal to a stored signal maintained in the non-volatile memory 28. This allows the logic arrangement 22 to provide an input to the main processing controller 20 to operate in mode 1, if a match is obtained between the stored signal and the detected signal, or to operate in mode 2 if there is not a match.

Mode 1 is a full function mode and allows the alarm panel to function with any or all of the various features thereof. Mode 2 is a restricted functionality mode which may allow limited functionality varying from merely powering up and providing a message that the environment of the panel is inappropriate, to a state similar to full functionality but with an ongoing error message, or other restricted functionality. For example, it may be desirable to allow the alarm panel to operate as a stand-alone security system and to disable the communication port 10.

Figure 3:
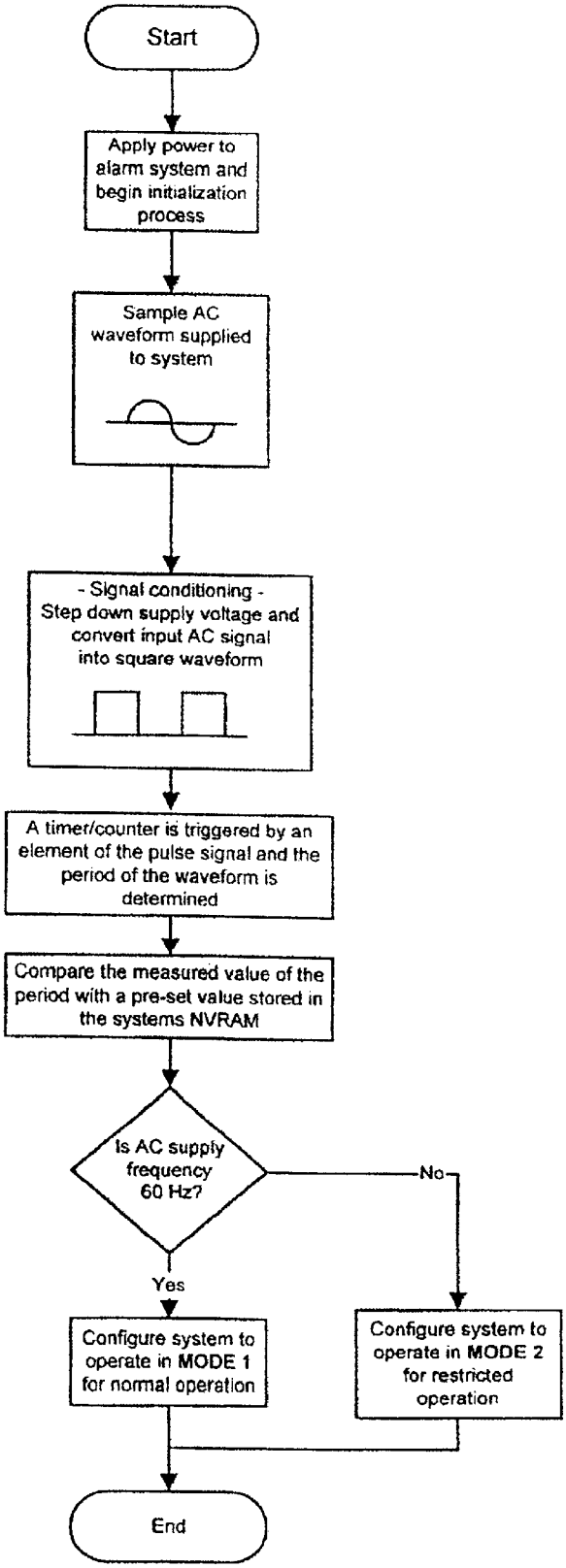
FIG. 3 is a logic flow chart.

The logic diagram of FIG. 3 illustrates the steps of sampling the power supply during initial start-up of the alarm panel and subsequent processing. The sensed signal is compared to a standard to determine whether the signal has a frequency of 60 Hz. If this comparison confirms the frequency of 60 Hz, then the alarm panel operates in mode 1. If the comparison indicates that the frequency is not 60 Hz, it operates in mode 2. Mode 1 programs the alarm control panel in one manner and mode 2 programs the control panel in a restricted manner.

It is also possible to sample the signal provided to the telecommunication port and to test this signal whenever the alarm panel is connected to this supply. Certain telephone systems operate in a different manner and provide a different stand-by voltage and a different voltage when the device goes off-hook. An analysis of these signals can determine whether the alarm control panel is appropriate to interact with the connected telephone system.

The alarm control panel has been described where the environment is checked by analyzing a power signal or a communication signal. The control panel could also analyze both these signals. A further possibility is for the alarm panel to call out on initial installation to a 800 number and caller ID capability could provide location information from the area code. This can then be used to determine whether mode 1 or mode 2 should be used.

It is also practical for the device to evaluate the signals to recognize a particular environment which is not suitable and when detected the panel does not operate or operates in a restricted mode. This feature is particularly appropriate if the manufacturer knows of certain problem territories or countries and includes sensing procedures to specifically identify these environments. The combination of power supply characteristics and communication characteristics typically uniquely identifies an area and even if it is not a unique identification, the panel would be restricted for all areas having these characteristics.

Therefor the panel can include environmental sensing for determination of an environment which meets certain criteria and/or an environment which is not suitable.

As one example, the power supply in Australia is 220 volts at 50 Hz. The dial tone frequency in Australia is 425 Hz +20% and the busy tone is 400 Hz. These parameters or other parameters can be used to distinguish from other environments for example Canada. In Canada the power supply is 120 volts at 60 Hz. The dial tone is 350 Hz plus 440 Hz and the busy tone is 480 Hz plus 620 Hz.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In an alarm control panel for processing signals from sensors and from a key pad and reporting of certain sensed conditions to a monitoring station, said alarm control panel including means for analyzing an electrical feed provided to said alarm control panel on a continuous basis and is indicative of the operating environment of the alarm panel, and comparing said analyzed electrical feed to a predetermined stored value; said alarm control panel operating in a first mode based on a match between said analyzed electrical feed and said stored value and operating in a second mode when said analyzed electrical feed and said stored value do not match, said alarm control panel in said first mode being in a full function mode and said panel in said second mode functioning in a restricted mode and wherein said electrical feed is separate and distinct from said signals from said sensors and keypad.

2. In a alarm control panel as claimed in claim 1 wherein said electrical feed is a power feed provided to said alarm control panel.

3. In a alarm control panel as claimed in claim 1 wherein said electrical feed is a telecommunication feed provided to said alarm control panel.

4. In a alarm control panel as claimed in claim 1 wherein said panel when operating in said second mode is disconnected from a telecommunication port used in said first mode for communication with a monitoring station.

5. In a alarm control panel as claimed in claim 1 wherein said means for analyzing an electrical feed is activated each time said panel is connected to a supply power source.

6. In a alarm control panel as claimed in claim 1 wherein said analyzed electrical feed is frequency analyzed and said stored value is a frequency value.

7. In a alarm control panel as claimed in claim 6 wherein said stored frequency value corresponds to 60 Hz.

8. In a alarm control panel as claimed in claim 3 wherein said predetermined value corresponds to a voltage value.

9. In a alarm control panel for processing signals from sensors and a key pad and reporting of certain sensed conditions to a monitoring station, said alarm control panel including means for analyzing a telecommunication signal associated with a telecommunication port of said panel which is connected to a public telecommunication system to determine the approximate geographic location information of said alarm control panel and comparing said approximate geographic location with a predetermined standard stored in memory of said alarm control panel, said alarm control panel operating in a first mode based on a match between said determined approximate geographic location and said standard, and operating in a second mode when said determined approximate location and said standard do not match, said alarm control panel in said first mode being in a full function mode and said panel in said second mode having limited functionality.

10. In an alarm control panel for processing signals from sensors and from a key pad and reporting of certain sensed conditions to a monitoring station, said alarm control panel including means for analyzing an electrical power feed provided to said alarm control panel and comparing said analyzed electrical power feed to at least one predetermined stored value, said alarm control panel operating in a first mode or a second mode based on a comparison between said analyzed electrical power feed and said at least one stored value, said alarm control panel in said first mode being in a full function mode and said panel in said second mode functioning in a restricted mode.

11. In an alarm panel as claimed in claim 10 wherein said at least one stored value includes stored values indicating a specific environment and when detected said alarm panel functions in a restricted mode.

12. In an alarm panel as claimed in claim 11 wherein said restricted mode is a non operating mode.

* * * * *